US006219303B1

(12) United States Patent
Morohoshi et al.

(10) Patent No.: US 6,219,303 B1
(45) Date of Patent: Apr. 17, 2001

(54) ELECTRONIC DEVICE WITH CLOCK FUNCTION, TIME CORRECTION METHOD AND RECORDING MEDIUM

(75) Inventors: Hiroshi Morohoshi, Tokorozawa; Shoichi Nagatomo, Fussa, both of (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 09/543,722

(22) Filed: Apr. 5, 2000

(30) Foreign Application Priority Data

Apr. 9, 1999 (JP) ..... 11-102495
Mar. 15, 2000 (JP) ..... 12-071565

(51) Int. Cl.[7] ..... G04C 11/02
(52) U.S. Cl. ..... 368/47; 368/187
(58) Field of Search ..... 368/10, 47, 187; 455/32.1, 51, 68, 70, 132

(56) References Cited

U.S. PATENT DOCUMENTS 5,712,867 * 1/1998 Yokeu et al. ..... 375/202
5,724,316 * 3/1998 Brunts ..... 368/10
5,774,057 * 6/1998 Kausermatter ..... 340/825.21
5,898,643 * 4/1999 Yasuoka et al. ..... 368/47

* cited by examiner

*Primary Examiner*—Vit Miska
(74) *Attorney, Agent, or Firm*—Frishauf, Holtz, Goodman, Langer & Chick, P.C.

(57) ABSTRACT

A wristwatch receives time-of-day information transmitted in the form of an infrared signal and then calculates the difference between the received time-of-day information and its time data. A decision is made as to whether the difference is not less than or less than a predetermined value. If the difference is less than the predetermined value, the accuracy of the received data and the accuracy set in the wristwatch are determined by referring to the types of time-measuring references. When the received data is higher accurate, the current time data stored by the first storage area is corrected by the received time data.

19 Claims, 20 Drawing Sheets

| REFERENCE | RANK |
|---|---|
| ATOMIC CLOCK | A |
| GPS | B |
| RADIO CLOCK | C |
| BUILT-IN CLOCK | D |

291

| 292 REFERENCE | 293 RANK |
|---|---|
| ATOMIC CLOCK | A |
| GPS | B |
| RADIO CLOCK | C |
| TCXO | D |
| BUILT-IN CLOCK | E |
| OTHER CLOCK | F |

212

| BINARY DATA | TYPE | CONTENTS | FLAG F |
|---|---|---|---|
| 0X01 | ATOMIC CLOCK | ATOMIC | 0 |
| 0X02 | GPS | GPS | 0 |
| 0X03 | RADIO CONTROLLED CLOCK | RADIO | 0 |
| 0X04 | TCXO GENERATED CLOCK | TCXO | 0 |
| 0X05 | BUILT-IN CLOCK | QUARTZ | 1 |
| 0X06 | OTHER | UNDEFIN | 0 |

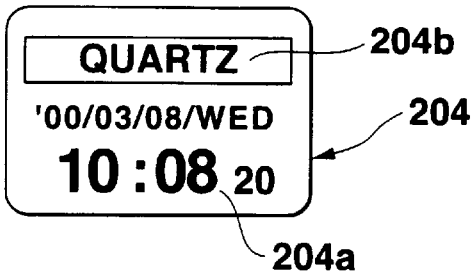
FIG.17A
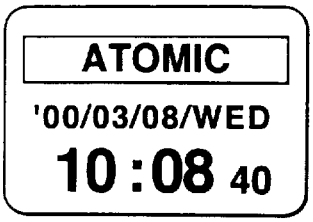
FIG.17B
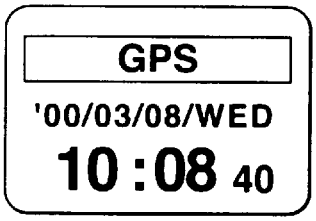
FIG.17C
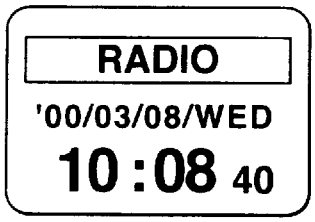
FIG.17D
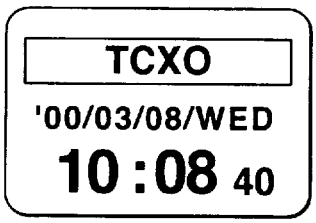
FIG.17E
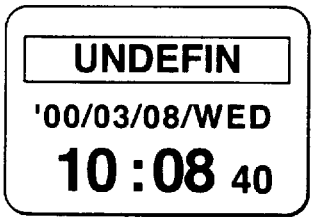
FIG.17F
213
| BINARY DATA | TIME DIFFERENCE DATA |
|---|---|
| 0X05 | -00:00:40(S) |
FIG.18

ELECTRONIC DEVICE WITH CLOCK FUNCTION, TIME CORRECTION METHOD AND RECORDING MEDIUM

CROSS-REFERENCE TO RELATED APPLICATIONS

This application is based upon and claims the benefit of priority from the prior Japanese Patent Applications No. 11-102495, filed Apr. 9, 1999; and No. 2000-071565, filed Mar. 15, 2000, the entire contents of which are incorporated herein by reference.

BACKGROUND OF THE INVENTION

The present invention relates to an electronic device with clock function adapted to correct time information based on received time data and a time information correction method.

To date, there has been proposals for time information correction methods using radiocommunications or infrared communications. Besides time information of year, month, day, hour, minute, and second, the format of time data transmitted for infrared communication-based time information correction includes the presence or absence of a time-measuring reference to which the time information is referenced and the type of the time-measuring reference. In this respect, this proposal differs from time correction methods using radiocommunications and GPS to transmit time-measuring reference data. Here, the type of time-measuring reference is information indicating which of a radio controlled clock, a global positioning system (GPS) and an atomic clock the time information is referenced to. The time information somewhat varies in accuracy depending on which of the radio controlled clock, GPS and atomic clock it is referenced to. Therefore, the type of time-measuring reference is also information indicating the accuracy of the time information.

However, the time correction function of conventional electronic devices with clock function makes forced time corrections based on received time information regardless of the accuracy of received time information. For this reason, corrections may be made though the time generated by the clock function is sufficiently accurate so as not to require corrections or changes may be made to less accurate time. This may result in reduced accuracy of electronic devices with clock function.

BRIEF SUMMARY OF THE INVENTION

Accordingly, it is an object of the present invention to provide an electronic device which has a clock function built in, which is capable of correcting time-of-day information to a higher level of accuracy.

According to the present invention, there is provided an electronic device with a clock function comprising clocking means for providing time information; first storage means for storing the time information provided by the clocking means and the type of a time-measuring reference to which the clocking means is referenced; display means for displaying the time information stored in the first storage means; second storage means for storing types of time-measuring references and their respective accuracies in the form of a time-measuring reference-to-accuracy mapping table; receiving means for receiving data transmitted from outside; detect means for detecting time information and the corresponding type of time-measuring reference from the received data by the receiving means; determining means for determining the accuracy of the time-measuring reference detected by the detecting means and the accuracy of the time-measuring reference stored in the first storage means based on the contents of the second storage means; and control means for controlling the contents of the first storage means based on the results of the determination by the determining means.

According to the present invention, since the accuracy of the type of time-measuring reference to which the received time data is referenced and the accuracy of the current time data are compared prior to correction of the current time data, it becomes possible to eliminate such a disadvantage as the current time data information is undesirably corrected by less accurate time information and hence the clock accuracy is reduced.

Additional objects and advantages of the present invention will be set forth in the description which follows, and in part will be obvious from the description, or may be learned by practice of the present invention.

The objects and advantages of the present invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the present invention and, together with the general description given above and the detailed description of the preferred embodiments given below, serve to explain the principles of the present invention in which:

FIGS. 17A through 17F show display examples;

FIG. 18 shows the contents of the third storage area in FIG. 15;

DETAILED DESCRIPTION OF THE INVENTION

A preferred embodiment of an electronic device having a clock function according to the present invention will now be described with reference to the accompanying drawings.

First Embodiment

Figure 1:
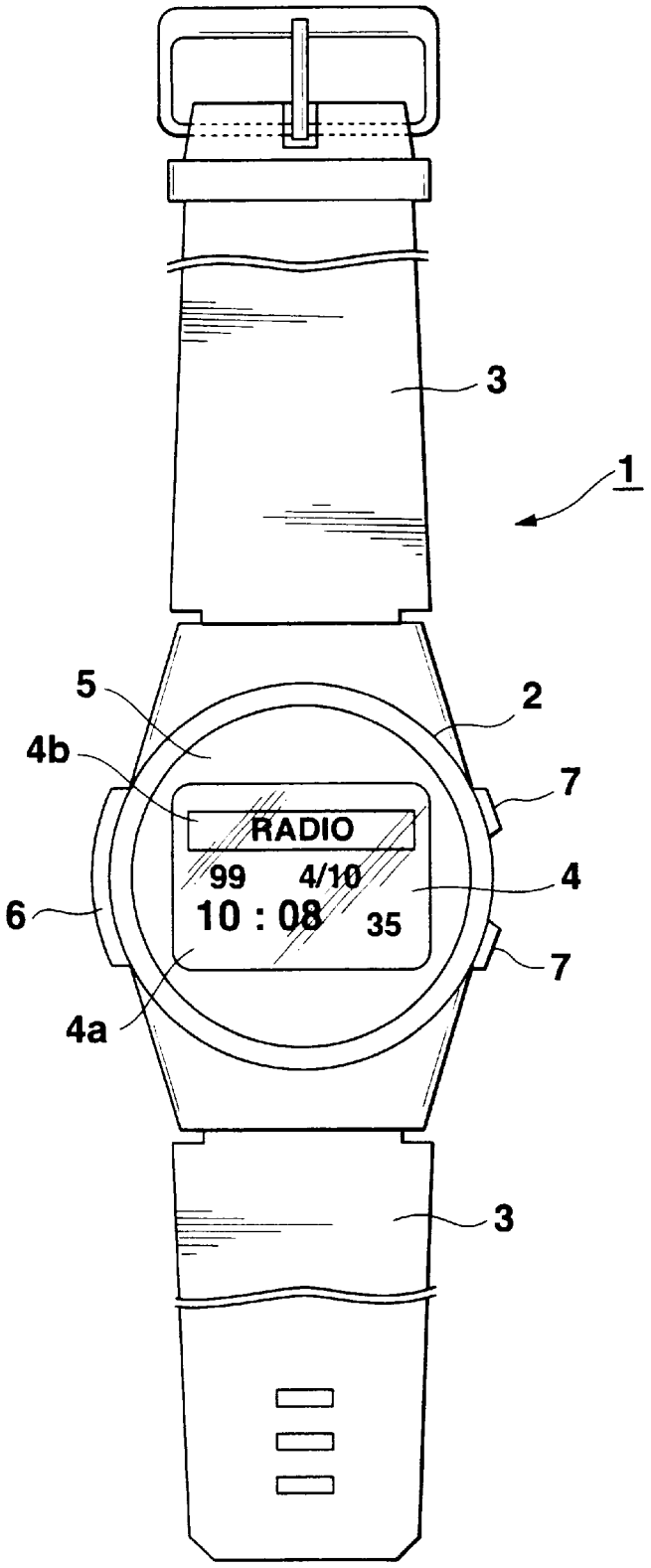
FIG. 1 is an exterior view of a wristwatch according to a first embodiment of the present invention.

The first embodiment is an application of the invention to a wristwatch. The wristwatch 1 is composed, as shown in FIG. 1, of a watch body 2 and a pair of bands 3 attached to both ends of the watch body 2. The watch body 2 is provided on top with a display 3 having an LCD 4 and has an infrared transmitter/receiver 6 and multiple switches 7 on opposite sides thereof.

Figure 2:
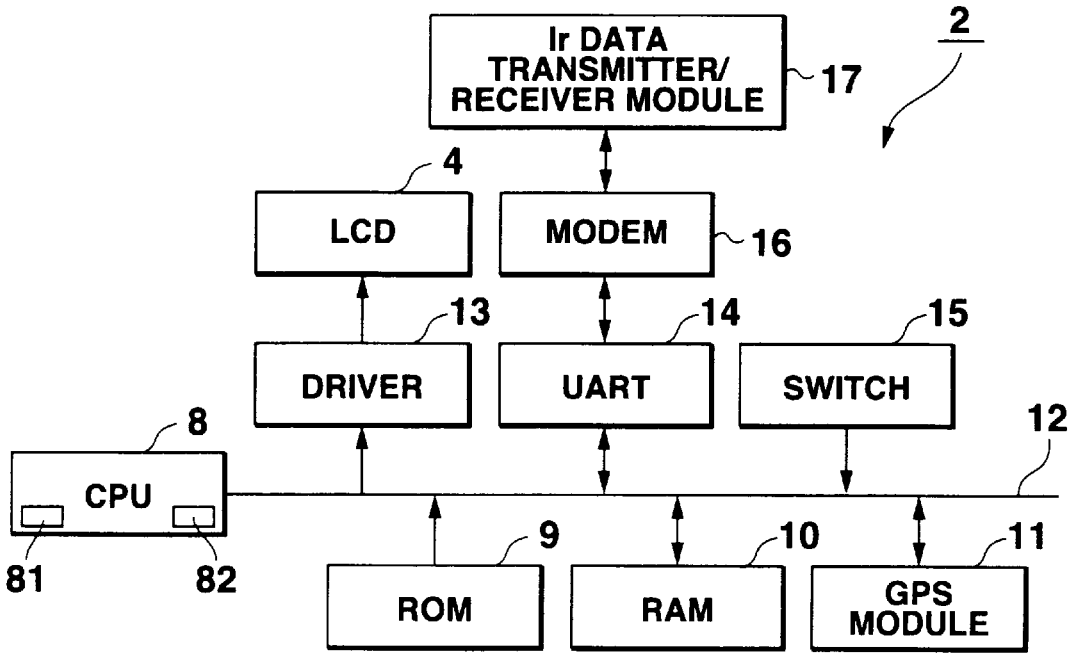
FIG. 2 is a block diagram of a circuit used in the wristwatch of FIG. 1.

FIG. 2 is a block diagram of a circuit placed inside the watch body 2. This circuit includes a CPU 8 to which a ROM 9, a RAM 10 and a GPS module 11 are connected by a bus 12. The CPU 8 controls various sections and generates a clock signal of a predetermined frequency. The CPU 8 also functions as timing means for generating time-of-day data (hereinafter abbreviated as time data) based on a clock signal. The CPU 8 includes an oscillator 81 for generating the clock signal and a phase-locked loop frequency synthesizer 82 for adjusting the clock speed of the clock signal. The ROM 9 stores a system program which is run on the CPU 8 and a table to be described later. The RAM 10 is used as working storage and has a storage area to be described later.

To the bus 12 are connected a driver 13, a UART (universal asynchronous receiver transmitter) 14 and a switch 15. The driver 14 is adapted to drive the LCD 4. To the UART 14 is connected through a modem (modulator-demodulator) 16 an Ir data transmitter/receiver module 17, which has the aforementioned infrared transmitter/receiver 6. The switch 15 produces key operation information when each of the keys 7 is operated.

Figure 3:
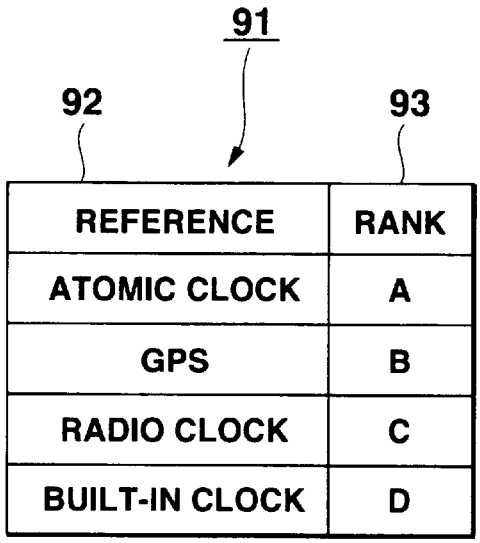
FIG. 3 is a schematic of a table used in the ROM of FIG. 2.

In the ROM 9 are stored the system program and such a table 91 as shown in FIG. 3. This table 91 has a reference storage area 92 and a rank storage area 92. The reference area 92 is stored with reference data indicating types of time-measuring reference, such as an atomic clock, a GPS, a radio controlled clock, and a built-in clock. The rank area 63 is stored with ranks of A, B, C, and D indicating the order of accuracy of the clocks in such a way that they are made to correspond one for one with the time-measuring reference. The accuracy of the time-measuring reference is in the order of A (atomic clock), B (GPS), C (radio controlled clock), and D (built-in clock). The atomic clock is the highest accurate.

Figure 4:
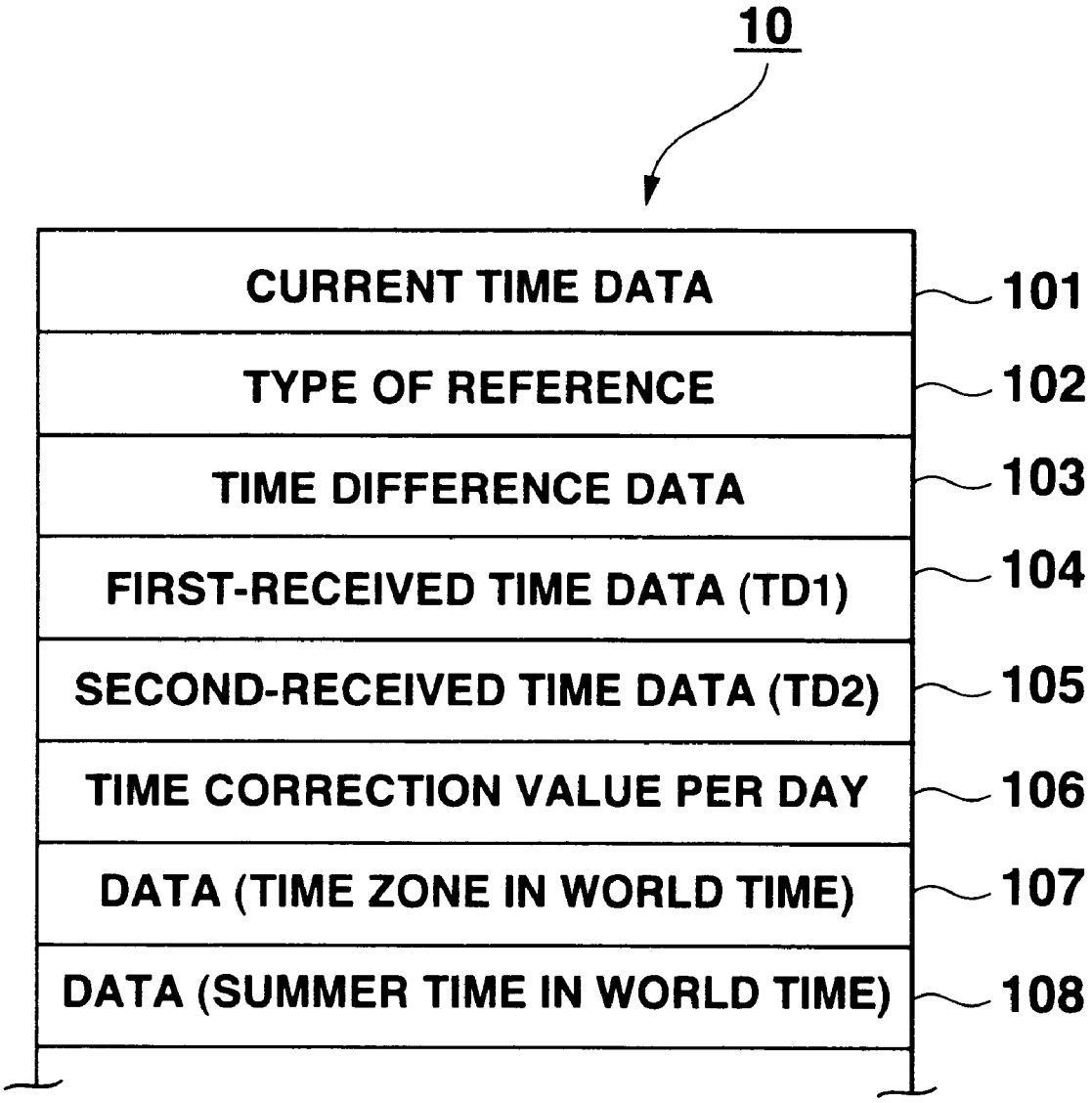
FIG. 4 shows the contents of a memory included in the RAM of FIG. 2.

The RAM 10 is provided in its portion with a first storage area 101 through an eighth storage area 108 as shown in FIG. 4. The first storage area 101 stores current time data generated by the CPU 8. The second area 102 stores data indicating the type of a time-measuring reference used in generating the current time data (time-measuring reference: atomic clock, GPS, radio controlled clock, or built-in clock). The third storage area 103 stores the difference between received time data and current time data stored in the first storage area 101.

The fourth storage area 104 stores time data received for the first time (first-received time data TD1). The fifth storage area 105 stores time data received for the second time (second-received time data TD2). The sixth storage area 106 stores a time correction value for day for adjusting "day" section of the time data, which is calculated from the first-time-received time data TD1 and the second-time-received time data TD2. The seventh storage area 107 stores time zone data in a world time for a location in which the current time data stored in the first storage area 101 is generated. The eighth storage area 108 stores summer time data (on/off of the summer time) for a location in which the current time data stored in the first storage area 101 is generated.

The CPU 8 drives the driver 13 according to the current time data stored in the first storage area 101, so that the current time 4*a* is displayed in the lower portion of the LCD 4 as shown in FIG. 1.

Figure 5:
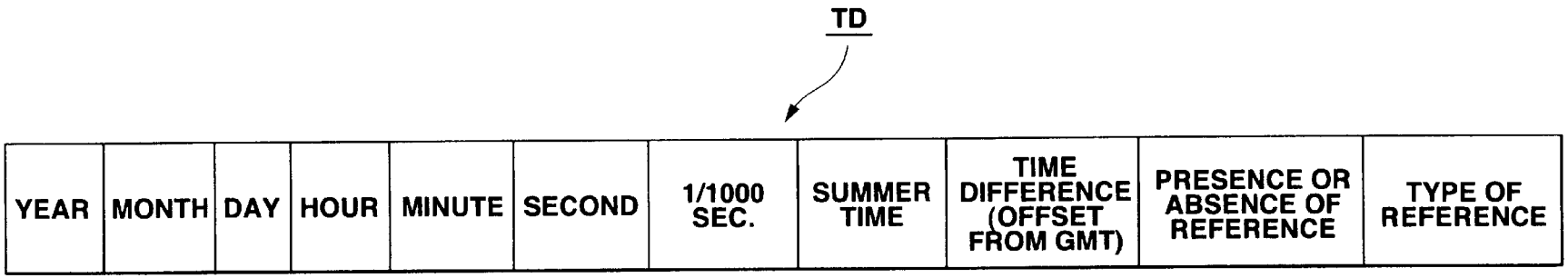
FIG. 5 shows the format of time data.

FIG. 5 shows the format of time data TD received by the Ir data transmit/receive module 17. This data format includes entries of "presence or absence of time-measuring reference" and "type of time-measuring reference" in addition to entries of the current time information for the location transmitting the time data TD, such as "year", "month", "day", "hour", "minute", "second", and "1/1000 sec.", and correction data such as "summer time" and "time difference (offset from GMT: Greenwich Mean Time)" for the location. The "presence or absence of time-measuring reference" is information indicating whether or not there is a time-measuring reference to which reference is made in generating the time data TD and the "type of time-measuring reference" is information indicating which of the atomic clock, GPS, radio controlled clock and built-in clock the time data TD is referenced to. The time data TD of the format as shown in FIG. 5 is sent from transmitting base stations installed in various locations or other wristwatches via infrared data communications.

Figure 6:
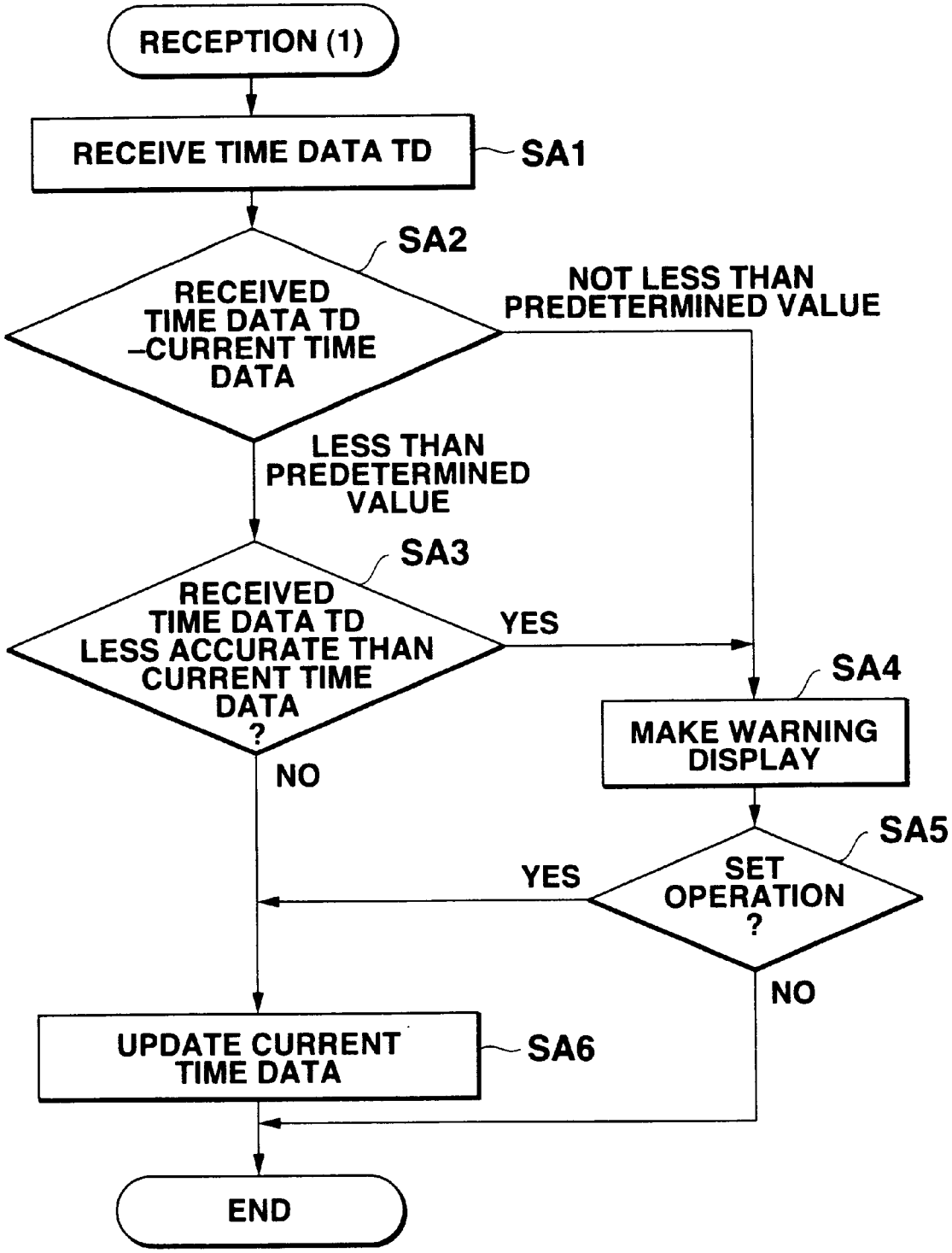
FIG. 6 is a flowchart for the process of reception (1)

Next, the operation of the first embodiment thus arranged will be described with reference to flowcharts. The CPU 8 executes the process shown by a flowchart in FIG. 6 and then or concurrently therewith carries out processes shown by flowcharts in FIGS. 7 through 11. As shown in FIG. 6, the CPU 8 carries out the process of receiving time data TD via infrared signals from electronic equipment (not shown) provided with infrared communications facility, such as a PC (personal computer), a PDA (personal digital assistant), a cellular phone or the like, in step SA1. More specifically, time data TD is sent from the nearest base station (infrared communications device) or wristwatch, then received by the Ir data transmitting/receiving module 17, demodulated by the modem 16 and subjected to conversion by the UART 14.

Next, the time difference between the received time data TD and the current time data stored in the first storage area 101 is calculated and a decision is then made as to whether the time difference is not less than or less than a predetermined value (step SA2). If the time difference is equal to or more than the predetermined value, then the LCD 4 is driven to make a warning display (step SA4). For this warning display, the reference data corresponding to the type of time-measuring reference in the time data TD received in step SA1 is read from the reference storage area 92 in the table 91 shown in FIG. 3 and then displayed. Thus, when the type of time-measuring reference in the received time data TD is radio controlled clock, "RADIO" is displayed as a reference data display 4*b* in the LCD 4 as shown in FIG. 1.

Thereafter, a decision is made as to whether or not a set operation is performed on the keys 7 (step SA5). If the set operation is performed, then the current time data stored in the first storage area 101 is corrected (updated) based on the received time data TD (by writing the received time data TD into the first storage area 101) (step SA6). When no set operation is performed, the procedure is terminated without correcting the current time. Thus, the user is allowed to determine whether not to perform a set operation after viewing the reference data display 4*b*. Thus, the current time data stored in the first storage area is protected from being corrected against user's will.

If, on the other hand, the decision in step SA2 is that the difference between the received time data and the current time data stored in the first storage area is less than the predetermined value, then a decision is made as to whether the accuracy of the received time data is lower than that of the current time data (step SA3). The received time data TD includes the entry of "type of time-measuring reference" indicating which of atomic clock, GPS, radio controlled clock and built-in clock the time data TD is referenced to and moreover the second storage area 102 stores the type of the time-measuring reference to which the current time data is referenced. Further, in the table 91 of FIG. 3, the time-measuring references are mapped into the ranks. Thus, the decision in step SA3 can be made by reading from the table 91 the rank corresponding to the time-measuring reference of the received time data TD and the rank of the current time and then making a comparison between them.

If the decision in step SA3 is that the received time data TD is less accurate than the current time data, then the aforementioned processes in steps SA4 and SA5 are carried out. In contrast to this, if the received time data TD is more accurate than the current time data, then the current time data stored in the first storage area 101 is automatically corrected by the received time data (step SA6).

In this embodiment, therefore, the current time data in the first storage area 101 is automatically rewritten by the received time data TD only when the difference between the received time data and the current time data is less than the predetermined value and the received time data is more accurate than the current time data.

Figure 7:
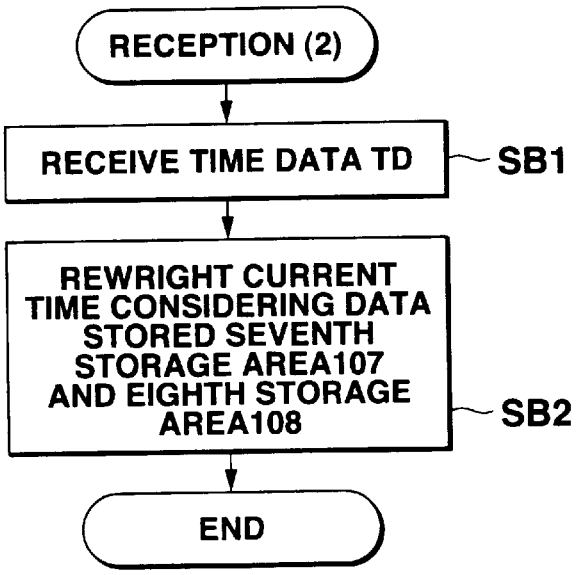
FIG. 7 is a flowchart for the process of reception (2)
Figure 8A:
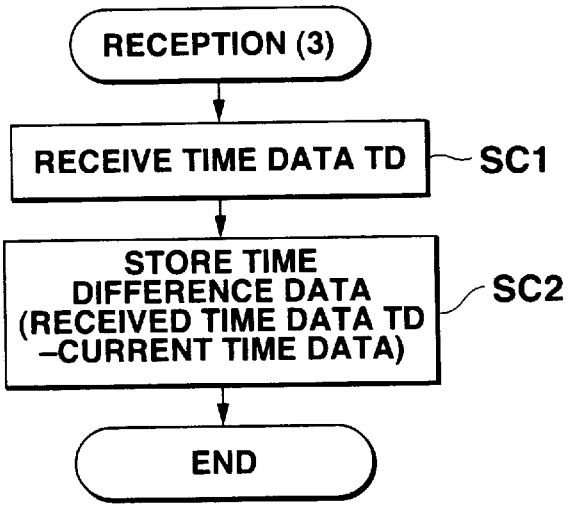
FIG. 8A is a flowchart for the process of reception (3)
Figure 10:
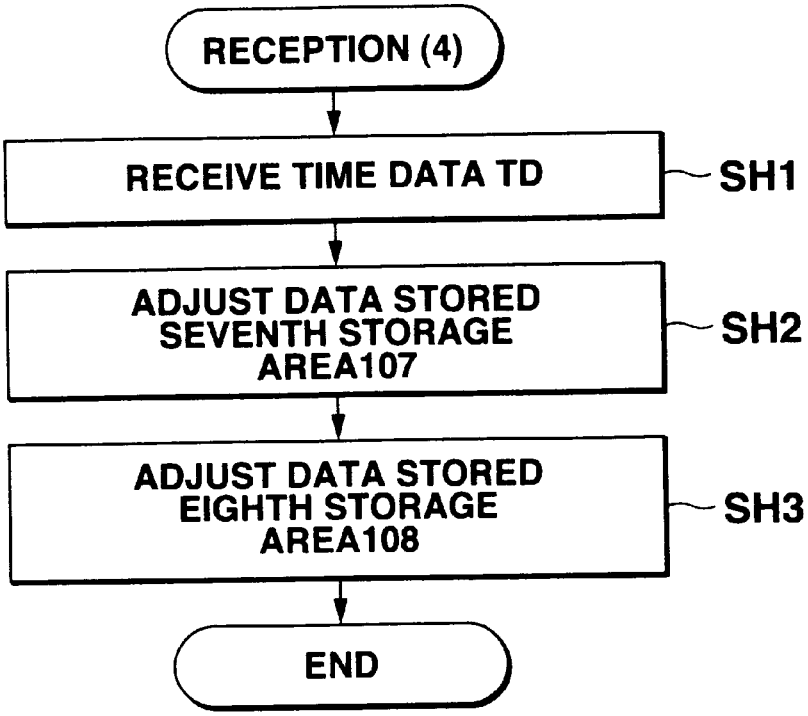
FIG. 10 is a flowchart for the process of reception (4)

The CPU 8 also carries out other reception processes shown in FIGS. 7, 8A, and 10 as well as the reception(l) process shown in FIG. 6. In the reception (2) process shown in FIG. 7, the CPU 8 receives the time data TD (step SB1). After that, the CPU 8 converts the "year", "month", "day", "hour", "minute", "second", and "1/1000 sec." in the received time data TD to GMT based on the "summer time" and "time difference from GMT", further converts the GMT to a local time based on the time zone data stored in the seventh storage area 107 and the summer time data stored in the eighth storage area 108, and rewrites the current time data stored in the first storage area 101 by the local time (step SB2).

In the reception (3) process shown in FIG. 8A, the CPU 8 receives the time data TD (step SC1). After that, the CPU 8 calculates the time difference between the received time data TD and the current time data stored in the first storage area 101 and then stores it in the third storage area 103 (step SC2).

Figure 8B:
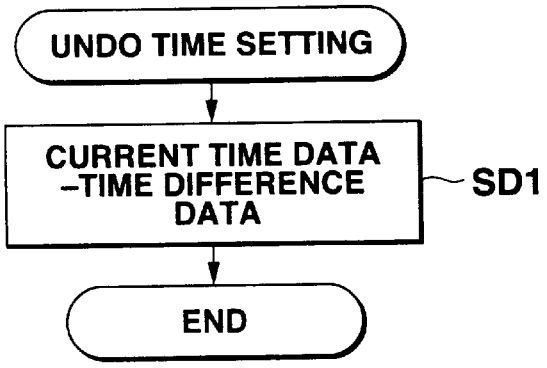
FIG. 8B is a flowchart for the time setting UNDO procedure.

When it is instructed to undo the time setting by the user by performing a given operation on the switches 7, the CPU 8 operates in accordance with a flowchart shown in FIG. 8B to subtract the time difference stored in the third storage area 103 from the current time data stored in the first storage area 101 and thus corrects the current time data stored in the first storage area 101 (step SD1). Thus, even if the current time data has been overwritten by the received time data at step SA6 in FIG. 6, a time setting UNDO operation will allow the current time data to be restored to the time data prior to rewriting.

Figure 9A:
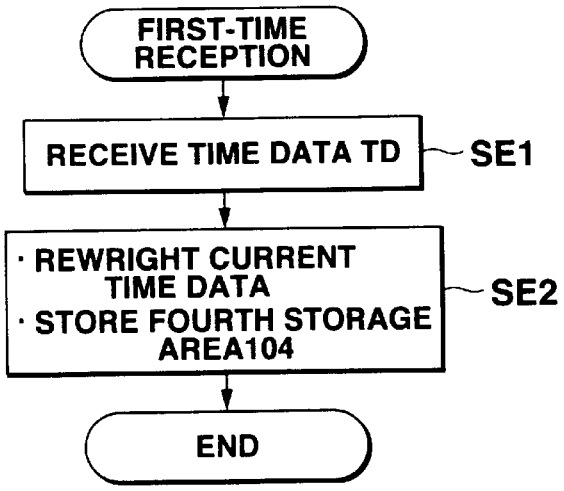
FIG. 9A is a flowchart for the first-time receive operation.
Figure 9B:
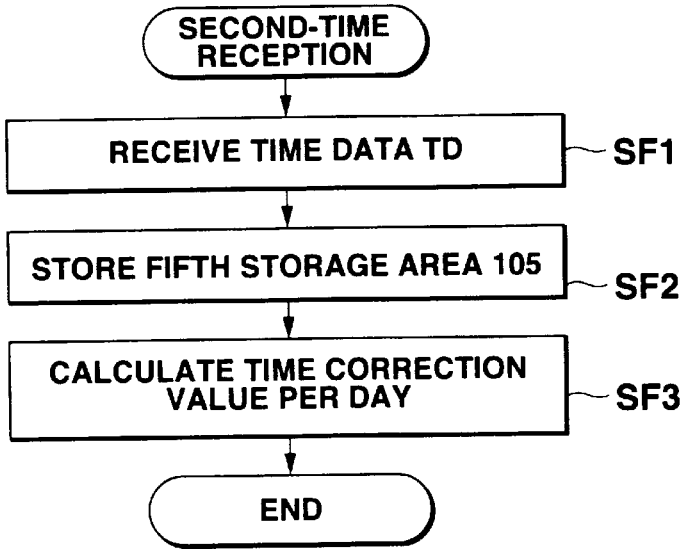
FIG. 9B is a flowchart for the second-time receive operation.
Figure 9C:
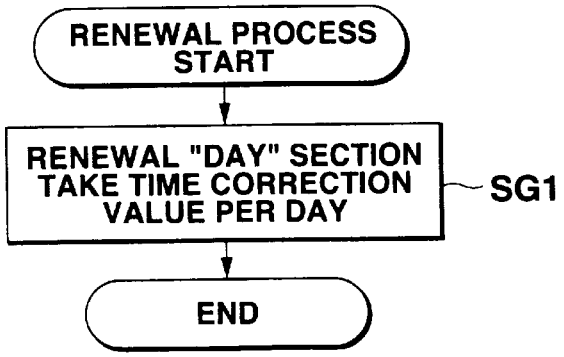
FIG. 9C is a flowchart for a correction process of "day" section.

In addition, the CPU 8 operates in accordance with flowcharts shown in FIGS. 9A to 9C to correct the time length of "day". The CPU 8 receives time data TD in the first-time reception (step SE1 in FIG. 9A). Then the CPU 8 corrects the current time data stored in the first storage area 101 by the received time data and stores the received time data TD in the fourth storage area 104 as first-received time data TD1 (step SE2). After that, the CPU 8 operates in accordance with a flowchart shown in FIG. 9B to receive time data TD again (step SF1) and then stores the received time data TD in the fifth storage area 105 as second-received time data TD2 (step SF2). Subsequently to step SF2, the CPU 8 calculates a time correction value per day based on the current time data rewritten at step SE2 and stored in the first storage area 101, the first-received time data TD1 stored in the fourth storage area 104, and the second-received time data TD2 stored in the fifth storage area 105 and then stores the time correction value per day in the sixth storage area 106 (step SF3).

That is, in step SF3, the CPU 8 first calculates the difference (hereinafter termed the first difference) between the rewritten current time data stored in the first storage area 101 and the first-received time data stored in the fourth storage area 104 and then calculates the difference (hereinafter termed the second difference) between the first-received time data stored in the fourth storage area 104 and the second-received time data stored in the fifth storage area 105. After that, the CPU 8 divides the first difference by the second difference. The result of division represents an error per the second difference, and thus it is possible to calculate the time correction value per day based on the result of division. If the second difference is 12 hours, the time correction value per day can be obtained by doubling the result of division. The accuracy of correction is improved if the second difference becomes longer. Therefore, the second reception time is set with considering the accuracy and an allowable waiting time for obtaining the correction value.

For a renewal process of "day", the CPU 8 corrects the "day" section in the current time data stored in the first storage area 101 by taking the time correction per day into consideration (step SG1 in FIG. 9C). This improves the accuracy of "day" in the time data generated by the wrist-watch 1.

If the CPU 8 has corrected the current time data in step SA6 in FIG. 6, it also operates in accordance with a flowchart shown in FIG. 10 to receive time data TD (step SH1). After that, the CPU 8 adjusts the time zone data stored in the seventh storage area 107 based on the time difference (offset from GMT) included in the received time data TD (step SH2). Further, the CPU 8 adjusts the summer time data stored in the eighth storage area 108 based on the summer time data included in the received time data TD (step SH3).

Figure 11:
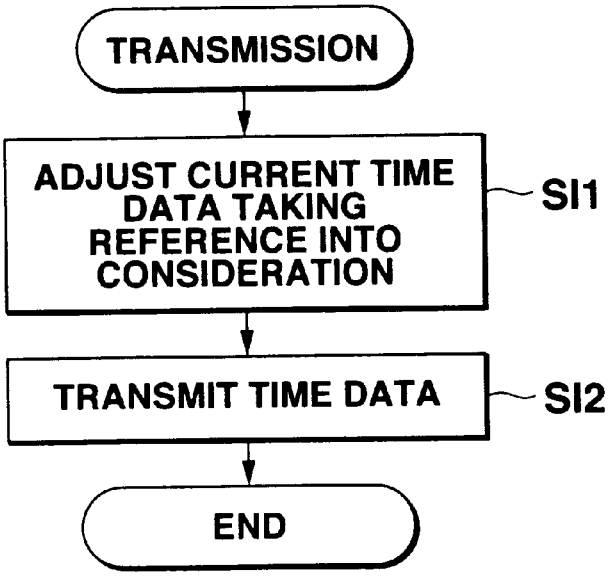
FIG. 11 is a flowchart for transmission procedure.

Additionally, the CPU 8 operates in accordance with a flowchart shown in FIG. 11 to perform a transmission process. That is, prior to transmission the CPU 8 adjusts the current time data by taking the time-measuring reference (atomic clock, GPS, or radio controlled clock) into consideration (step SI1) and then transmits the adjusted time data (step SI2). Thus, the adjusted time data is sent through the CPU 8, the UART 14, the modem 16, and the Ir transmitter/receiver module 17 to outside. Another wristwatch can receive the time data thus transmitted and correct own time data stored in its first storage area by the received time data, whereby accuracy of the other wristwatch is also improved.

According to the first embodiment, the accuracy of the time data of the wristwatch can be greatly improved.

Other embodiments of the present invention will be described. The same portions as those of the first embodiment will be indicated in the same reference numerals and their detailed description will be omitted.

Second Embodiment

Figure 12:
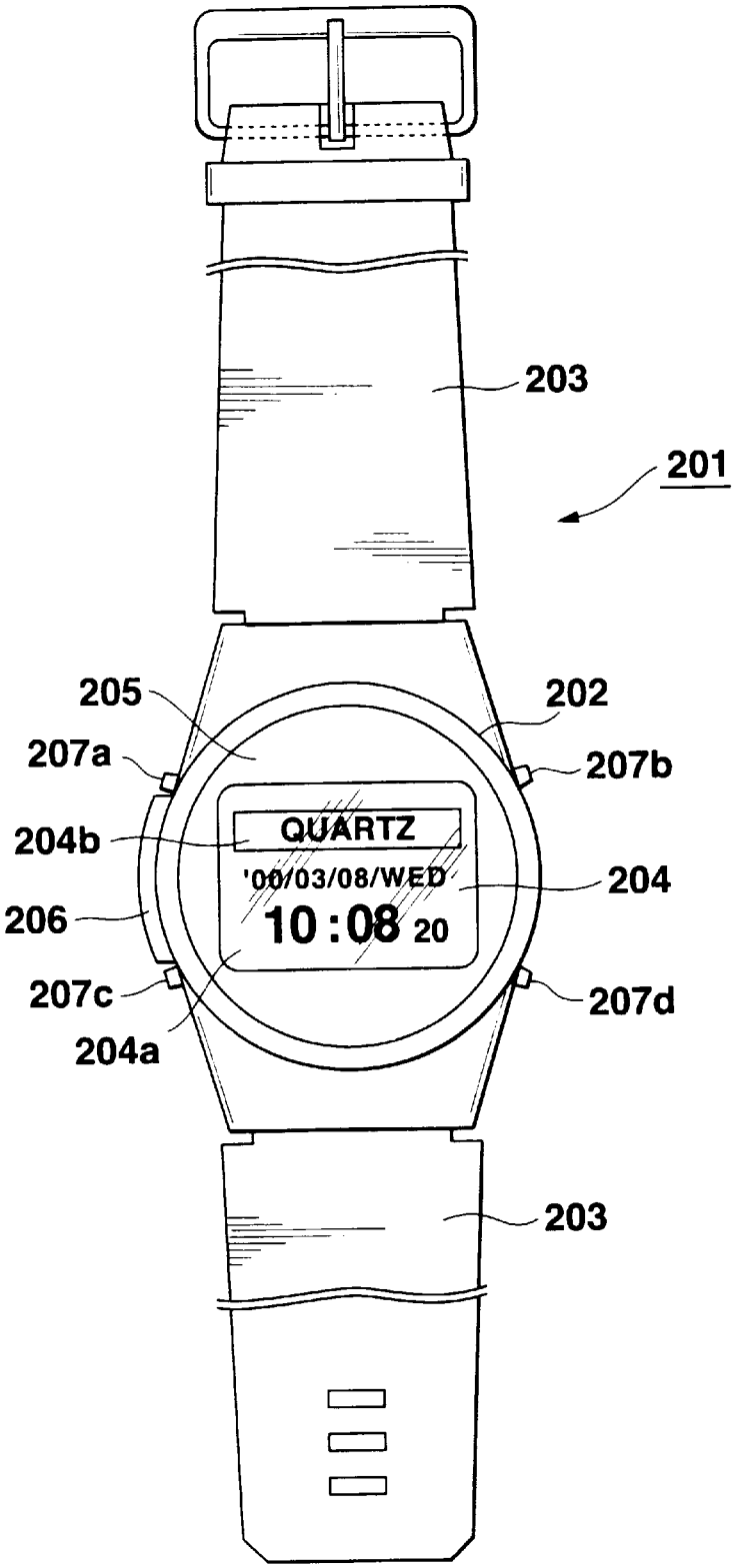
FIG. 12 is an exterior view of a wristwatch according to a second embodiment of the present invention.

Next, a second embodiment of the present invention will be described with reference to the accompanying drawings. This embodiment is also directed to a wristwatch. This wristwatch 201 is composed, as shown in FIG. 12, of a watch body 202 and bands 203 attached to both ends of the watch body 202. The watch body 202 is provided on top with a display 205 having an LCD 204 and has an infrared transmitter/receiver 206 and multiple switches 207*a* to 207*d* on opposite sides thereof. Though not shown in FIG. 12, the wristwatch is further equipped with an interface that is adapted to be linked to an external device so that various pieces of software may be downloaded from the external device to the wristwatch.

Figure 13:
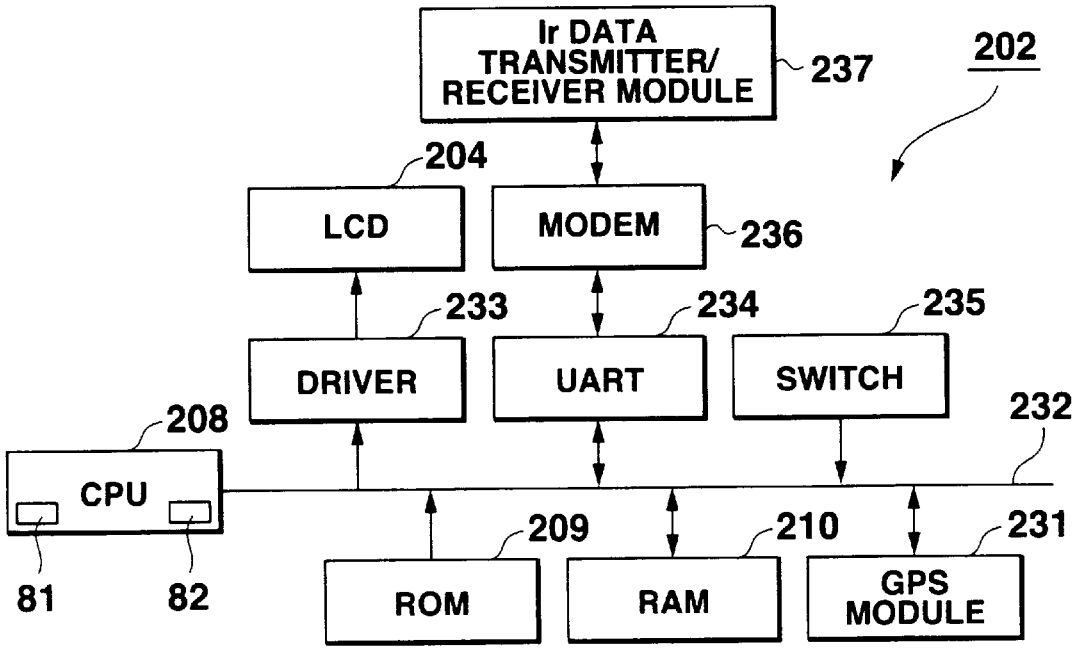
FIG. 13 is a block diagram of a circuit used in the wristwatch of FIG. 12.

FIG. 13 is a block diagram of a circuit placed inside the watch body 202. This circuit includes a CPU 208 to which a ROM 209, a RAM 210, a GPS module 231 and an interface (IF) 238 are connected by a bus 232. The CPU 208 controls various sections and generates a clock signal of a predetermined frequency. The CPU 208 also functions as timing means for generating time data based on the clock signal. The CPU 208 includes an oscillator 81 for generating the clock signal and a phase-locked loop frequency synthesizer 82 for adjusting the clock speed of the clock signal. The ROM 209 stores a system program according to which the CPU 208 operates and a table to be described later. The RAM 210 is used as working storage and has a storage area to be described later. The interface (IF) 238 is linked to an external computer 241 by a communication cable or line 239. The external computer 241 is equipped with a driver 242 which performs various control operations according to software loaded either from a recording medium 243, such as an FD or CD-ROM, or a communications network.

The recording medium 243 is recorded with software (program codes) that allows the CPU 208, the ROM 209 and the RAM 210 in the wristwatch 201 to perform control operations as implemented in the second embodiment.

To the bus 232 are connected a driver 233, a UART (universal asynchronous receiver transmitter) 234 and a switch 235. The driver 233 is adapted to drive the LCD 204. To the UART 234 is connected through a modem 236 an Ir data transmitter/receiver module 237, which has the aforementioned infrared transmitter/receiver 206. The switch 235 produces key operation information according to operations of the keys 207*a* to 207*d*.

Figure 14:
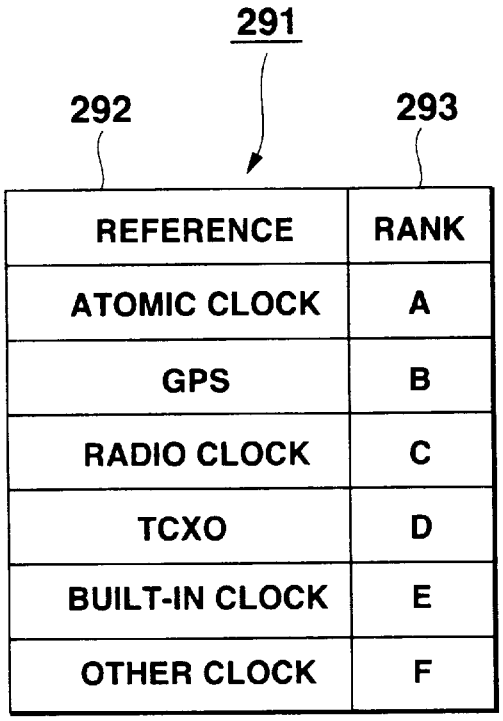
FIG. 14 is a schematic of a table used in the ROM of FIG. 13.

In the ROM 209 are stored the system program and such a table 291 as shown in FIG. 14. This table 291 has a reference storage area 292 and a rank storage area 293. The reference storage area 292 is stored with reference data indicating types of time-measuring reference, such as an atomic clock, a GPS, a radio controlled clock, a TCXO (temperature compensated crystal oscillator), a built-in clock and other clock. The rank area 293 is stored with ranks of A, B, C, D, E, and F indicating the order of accuracy of the time-measuring references. That is, in the table the time-measuring references are mapped into the ranks of accuracy. The accuracy of the time-measuring reference is in the order of A (atomic clock), B (GPS), C (radio controlled clock), D (TCXO), E (built-in clock), and F (other clock). The atomic clock is the highest accurate. The error of the TCXO is several tens of seconds per year and the error of the built-in clock is several tens of seconds per month.

Figures 15, 16:
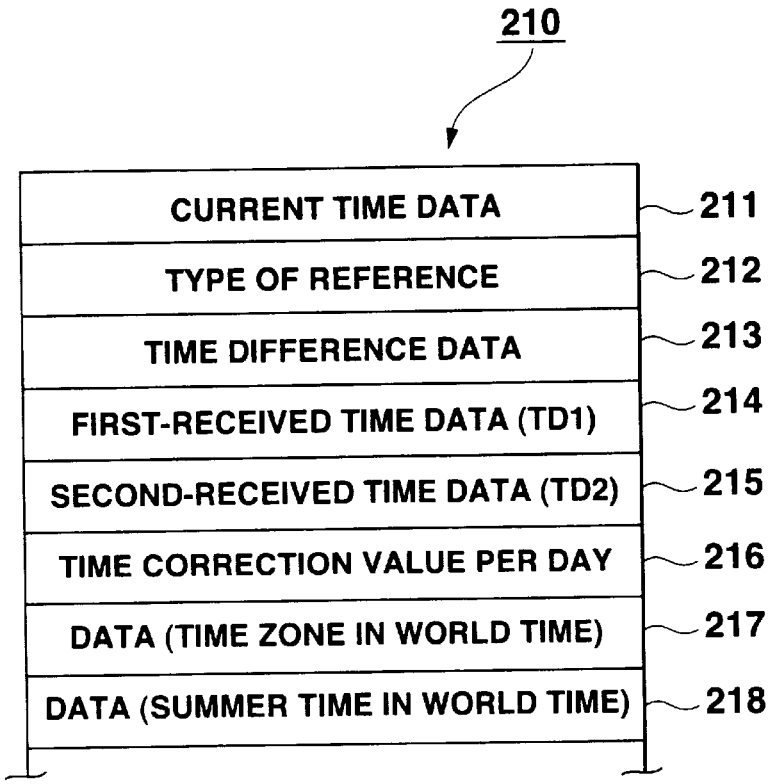
FIG. 15 shows the contents of a memory included in the RAM of FIG. 13.
FIG. 16 shows the contents of the second storage area in FIG. 15.

The RAM 210 is provided in its portion with a first storage area 211 through an eighth storage area 218 as shown in FIG. 15. The first storage area 211 stores current time data generated by the CPU 208. The second area 212 stores data indicating the type of a time-measuring reference used in generating the current time data (time-measuring reference: atomic clock, GPS, radio controlled clock, TCXO, built-in clock, or other clock).

The second area 212 has a table in which, as shown in FIG. 16, binary data, display contents and flags F are stored to correspond one for one with data indicating the types of time-measuring references used in generating time data (atomic clock, GPS, radio controlled clock, TCXO, built-in clock, or other clock). The display contents are character data used in displaying the type of the corresponding time-measuring reference on the LCD 204. When set to "1", each flag F indicates that reference is presently made to the corresponding time-measuring reference.

If the present time-measuring reference is the built-in clock, therefore, only the flag for built-in clock is set to "1" as shown in FIG. 16 and, when time setting mode is set, a reference data display 204*b* of "QUARTZ" is made as shown in FIGS. 12 and 17A. Also, when the present time-measuring reference is atomic clock, the corresponding flag F is set to "1" and a reference data display of "ATOMIC" is made as shown in FIG. 17B. Likewise, when the present time-measuring reference is GPS, the corresponding flag F is set to "1" and a reference data display of "GPS" is made as shown in FIG. 17C.

Additionally, when the present time-measuring reference is radio controlled clock, the corresponding flag F is set to "1" and a reference data display of "RADIO" is made as shown in FIG. 17D. When the present time-measuring reference is TCXO, the corresponding flag F is set to "1" and a reference data display of "TCXO" is made as shown in FIG. 17E. When the present time-measuring reference is some other clock, the corresponding flag F is set to "1" and a reference data display of "UNDEFIN" is made as shown in FIG. 17F.

Figure 19:
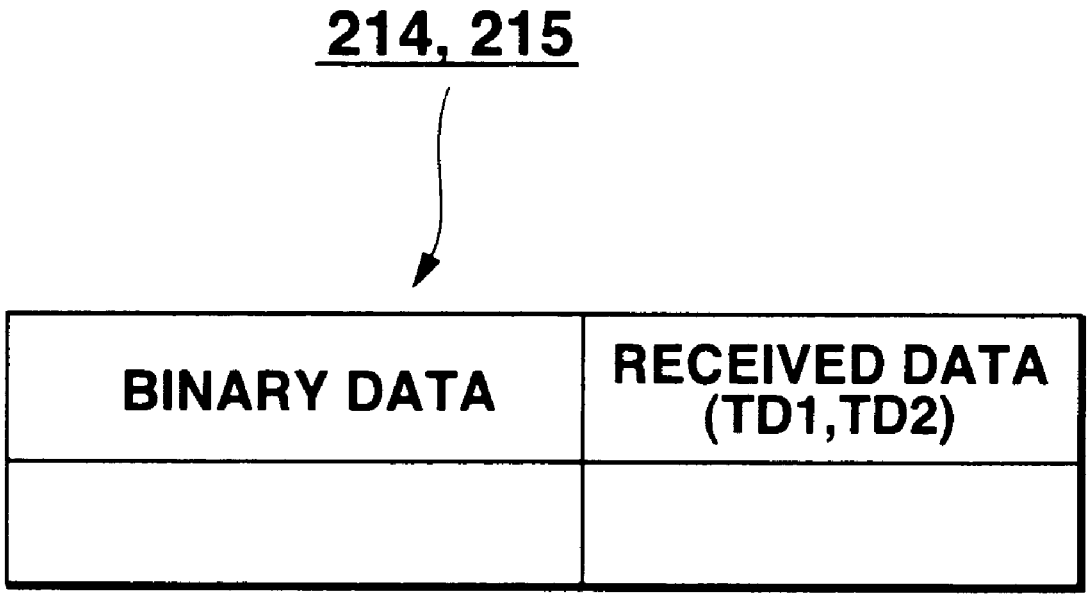
FIG. 19 shows the contents of the fourth and fifth storage areas in FIG. 15.

The third storage area 213 stores the difference between received time data and current time data stored in the first storage area 211 together with the binary data indicating the time-measuring reference as shown in FIG. 18. The fourth storage area 214 stores time data received for the first time (first-received time data TD1) together with the binary data indicating time-measuring reference as shown in FIG. 19. The fifth storage area 215 stores time data received for the second time (second-received time data TD2) together with the binary data indicating time-measuring reference as shown in FIG. 19. The sixth storage area 216 stores a time correction value for day for correcting "day" section of the time data, which is calculated from the first-time-received time data TD1 and the second-time-received time data TD2. The seventh storage area 217 stores time zone data in a world time for a location in which the current time data stored in the first storage area 211 is generated. The eighth storage area 218 stores summer time data (on/off of the summer time) for a location in which the current time data stored in the first storage area 211 is generated.

By the CPU 208 driving the driver 233 according to the first time data stored in the first storage area 211, the current time 204*a* is displayed on the segment display section in the lower portion of the LCD 204, as shown in FIG. 12 and FIGS. 17A to 17F.

Figure 20:
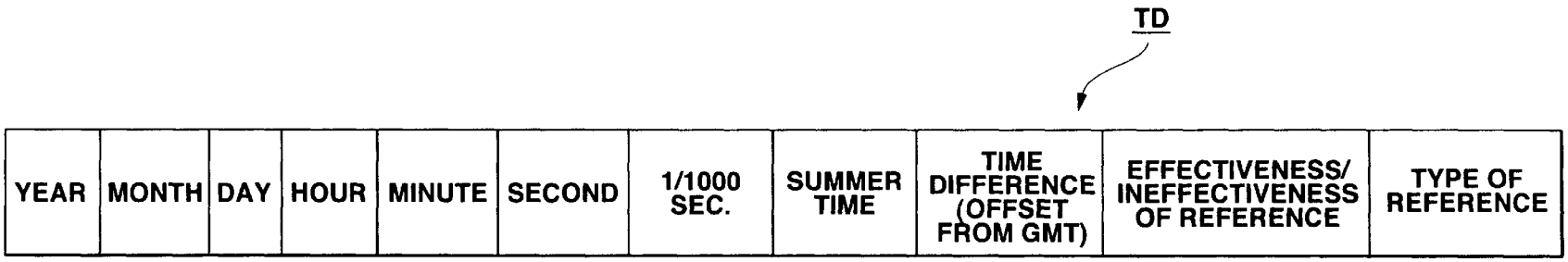
FIG. 20 shows the format of time data.

FIG. 20 shows the format of time data TD received by the Ir data transmit/receive module 237. This data format includes entries of "presence or absence of time-measuring reference" and "type of time-measuring reference" in addition to entries of the current time information for the location transmitting the time data TD, such as "year", "month", "day", "hour", "minute", "second", and "1/1000 sec.", and correction data such as "summer time" and "time difference (offset from GMT: Greenwich Mean Time)" for the location. The "presence or absence of time-measuring reference" is information indicating whether or not there is a time-measuring reference to which reference is made in generating the time data TD and the "type of time-measuring reference" is information indicating which of the atomic clock, GPS, radio controlled clock, TCXO, and built-in clock the time data TD is referenced to. The time data TD of the format as shown in FIG. 20 is sent from transmitting base stations installed in various locations or other wristwatches via infrared data communications.

In the second embodiment thus configured, if, when the flag F for built-in clock is in the set state as illustrated in FIG. 16, the time setting mode is set, the time-measuring reference data "QUARTZ" is displayed on the dot matrix display section 204*b* of the LCD 204, and the current time 204*a* based on the built-in clock is displayed as shown in FIGS. 12 and 17A.

Figure 21:
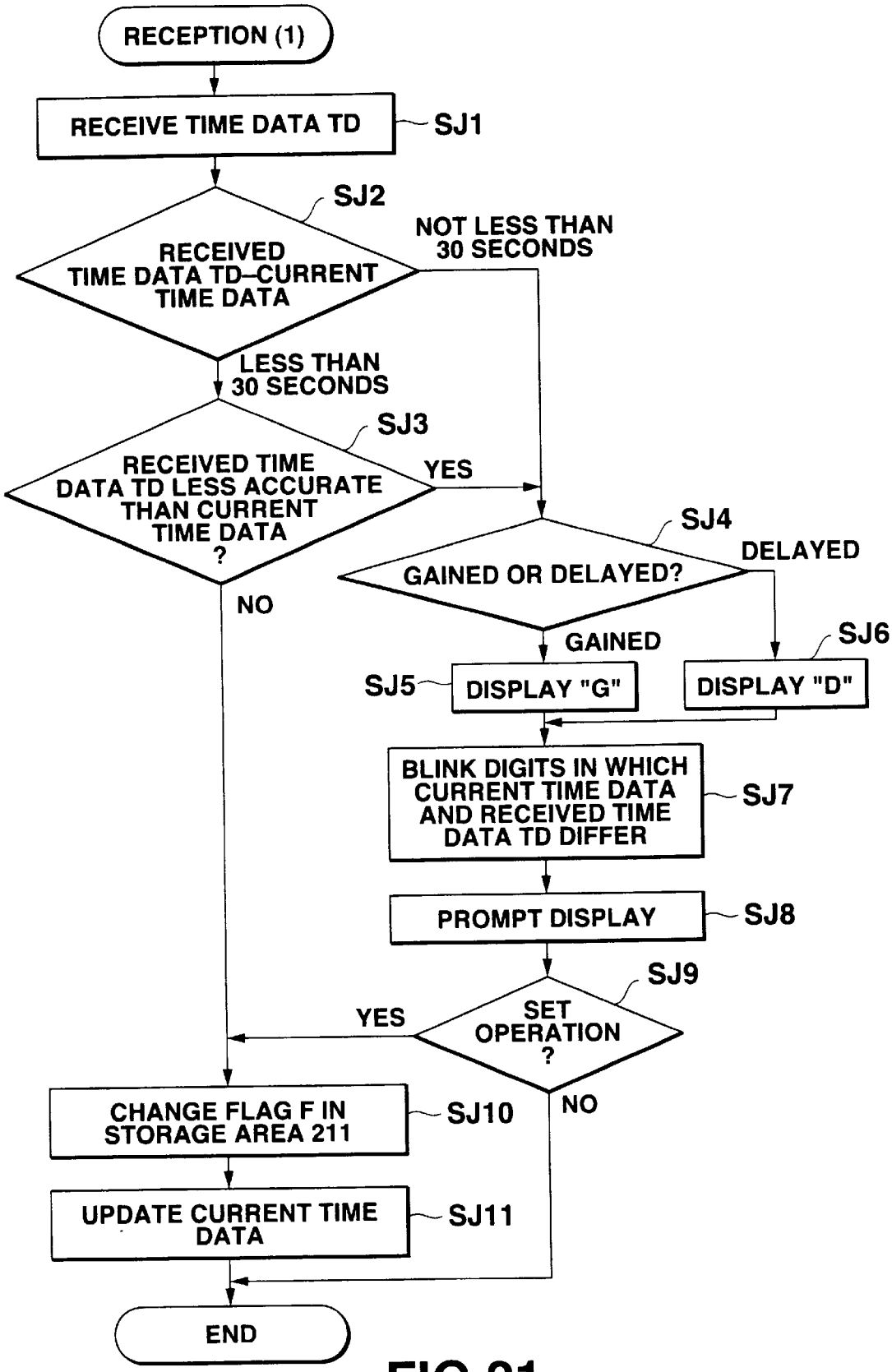
FIG. 21 is a flowchart for the process of reception (1)

The CPU 208 executes the process shown by a flowchart in FIG. 21 and then or concurrently therewith carries out each of processes shown by flowcharts in FIGS. 23 through 27. As shown in FIG. 21, the CPU 8 carries out the process of receiving time data TD in the form of infrared signals from electronic equipment (not shown) provided with infrared communications facility, such as a PC, a PDA, a cellular phone or the like, in step SJ1. More specifically, when time data TD is sent from the nearest base station (infrared communications device) or wristwatch, it is received by the Ir data transmitter/receiver module 237, then demodulated by the modem 236 and subjected to data conversion by the UART 234.

Next, the time difference between the received time data TD and the current time data stored in the first storage area 211 is calculated and a decision is then made as to whether the time difference is not less than or less than a predetermined value, e.g., a value corresponding to 30 seconds (step SJ2). If the time difference is equal to or larger than the predetermined value, then a decision is made as to whether the wristwatch 201 is gained or delayed (step SJ4). If the wristwatch is gained, then "G" is displayed on the LCD 204 (step SJ5). If, on the other hand, the wristwatch is delayed, then "D" is displayed (step SJ6). Thus, if the present wristwatch 201 is delayed, this process allows "D" indicating that the present wristwatch is delayed to be displayed as an accuracy display 204*c* on the LCD 204.

At the same time, a reference data display 204*b* and an Ir reception display 204*d* are also made. For the reference data display 204*b*, the display contents corresponding to binary data indicating the type of time-measuring reference included in the time data TD received in step SJ1 are read from the second storage area 212 (FIG. 16) and displayed. If, therefore, the binary data for the type of time-measuring reference included in the received time data TD corresponds to "radio controlled clock", the LCD 204 is changed from the state of FIG. 17A to the state of FIG. 22A in which "RADIO" is displayed as the reference data display 204*b*. The reference data display 204*b* allows the user to know the type of time-measuring reference and consequently the accuracy of the time-measuring reference.

Figure 22A:
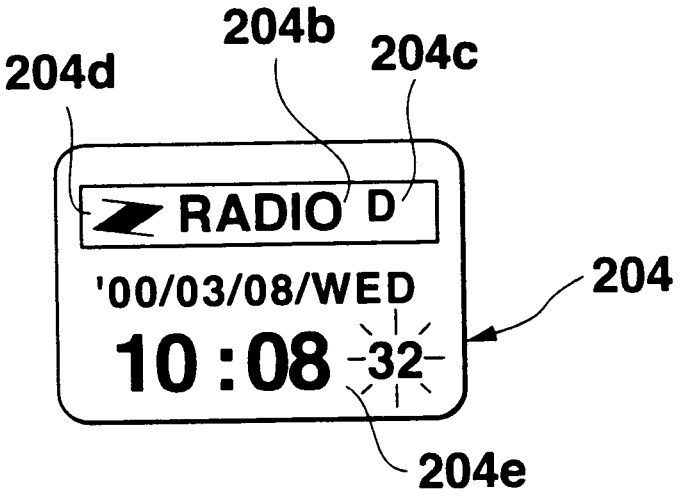
FIGS. 22A through 22C are display transition diagrams associated with the operation of reception(1)

On termination of step SJ5 or step SJ6, digits of the current time data that differ from the received time-measuring reference are displayed with blinking (step SJ7). That is, of digits of hours, minutes and seconds, numeric characters that differ from those of the time-measuring reference are displayed blinked. For example, assume that differences arise only in digits of minutes. Then, numeric characters "32" that are digits 204*e* of seconds are displayed blinked as shown in FIG. 22A.

Figure 22B:
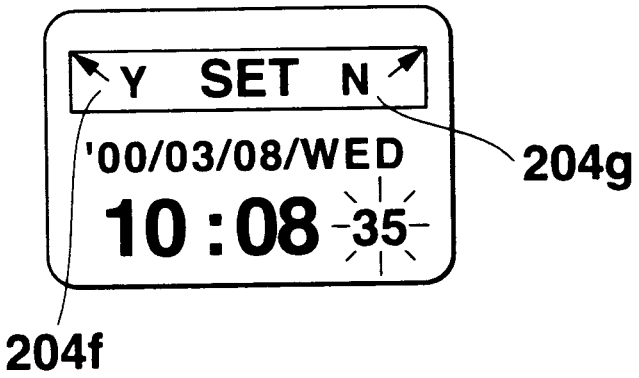

After that, a prompt display is made (step SJ8). For this display, as shown in FIG. 22B, a positive prompt display 204*f* and a negative prompt display 204g are made on the LCD 204. The positive prompt display 204*f* and the negative prompt display 204g are each composed of an arrow and a character of "Y" or "N". The arrow in the positive prompt display 204*f* points to the key 207*a*, while the arrow in the negative prompt display 204g points to the key 207*b*. That is, the prompt displays indicate to the user that the key 207*a* is to be operated (set operation) when the current time data stored in the first storage area 211 is to be corrected by the received time-measuring reference data, otherwise, the key 207*b* is to be operated.

Figure 22C:
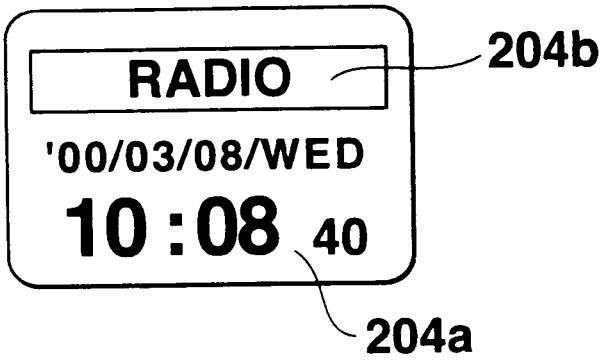

After that, a decision is made as to whether or not the key 207*a* has been operated (step SJ9). When a set operation has been performed by the key 207*a* (YES in step SJ9), a change is made to the flags in the second storage area 212 so as to set the flag corresponding to the type of time-measuring reference data used for correcting the current time data to "1". In the example of FIG. 22A, since the type of time-measuring reference used for correcting is "radio controlled clock" corresponding to "RADIO", the flag F for radio controlled clock is set to "1". Next, the current time data stored in the first storage area 211 is overwritten by the received time data (step SJ11). Thereby, the current time 204*a* displayed on the LCD 204 is also corrected as shown in FIG. 22C.

However, when it is not the key 207*a* that has been operated, but the key 207*b*, the decision in step SJ9 is NO. In this case, the procedure comes to an end without rewriting. Therefore, the user simply determine whether or not to perform a set operation after confirming the reference data display 204*b*. For this reason, it becomes possible to prevent rewriting from being carried out against user's will.

If, on the other hand, the decision in step SJ2 is that the difference between the received time data and the current time data is less than 30 seconds, then a decision is made as to whether the received time data is lower in accuracy than the current time data (step SJ3). That is, the received time data TD contains binary data indicating the type of time-measuring reference to which it is referenced, such as atomic clock, GPS, radio controlled clock, TCXO, built-in clock in the sending end, or others, and the second storage area 212 stores the type of time-measuring reference to which the current time data is referenced. Moreover, the time-measuring references are ranked in their accuracy in the table 291 of FIG. 14. Thus, in step SJ3, the decision can be made by reading from the table 291 the rank of the time-measuring reference for the received time data TD and the rank of the time-measuring reference for the current time data and then making a comparison between them.

If the decision in step SJ3 is that the received time data TD is less accurate than the current time data, then the above-mentioned steps SJ4 through SJ9 are performed. If, on the other hand, the received time data TD is more accurate than the current time data, then a change is made to the flags F in the second storage area 212 (step SJ10) and the current time data stored in the first storage area 211 is rewritten by the received time data TD (step SJ11).

In this embodiment, therefore, the current time data in the first storage area 211 is automatically rewritten by the received time data TD only when the difference between the time data TD and the current time data is less than the predetermined value and the time data TD is more accurate than the current time data.

Figure 23:
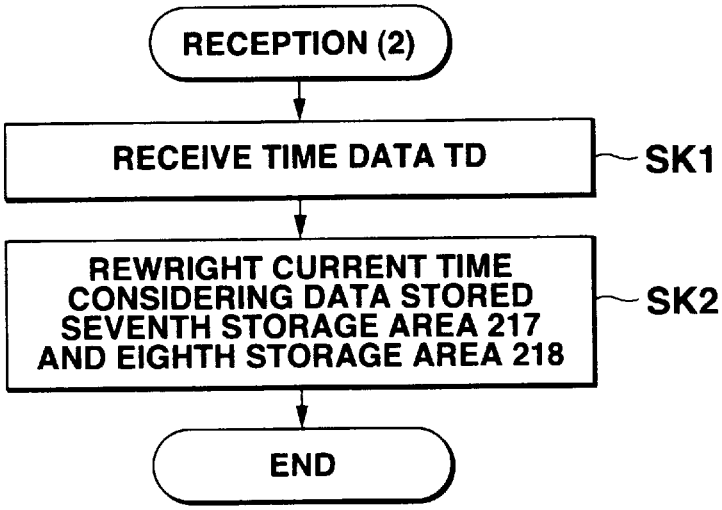
FIG. 23 is a flowchart for the process of reception (2)
Figure 24A:
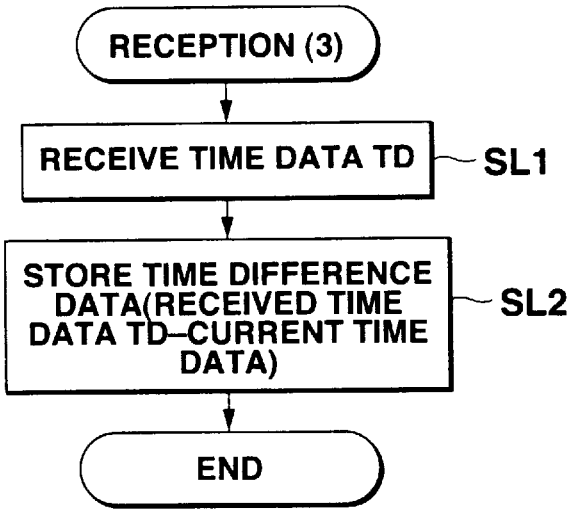
FIG. 24 is a flowchart for the process of reception (3)
FIG. 24B is a flowchart for the time setting UNDO procedure.
Figure 26:
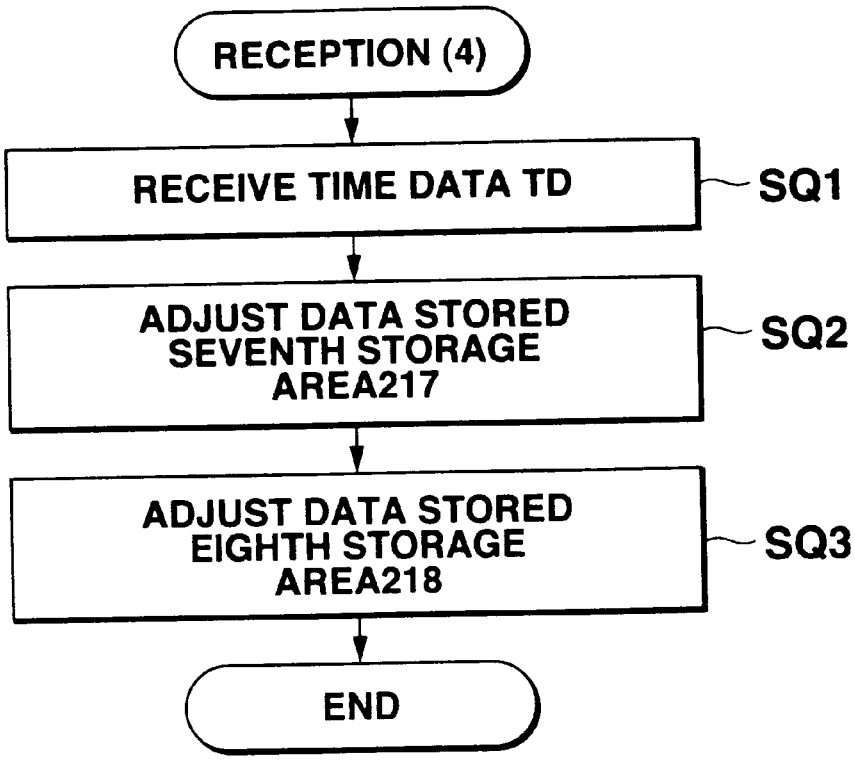
FIG. 26 is a flowchart for the process of reception (4)

The CPU 208 also carries out other reception processes shown in FIGS. 23, 24A, and 26 as well as the reception (1) process shown in FIG. 21. In the reception (2) process shown in FIG. 23, the CPU 208 receives the time data TD (step SKi). After that, the CPU 208 converts the "year", "month", "day", "hour", "minute", "second", and "1/1000 sec." in the received time data TD to GMT based on the "summer time" and "time difference from GMT", further converts the GMT to a local time based on the time zone data stored in the seventh storage area 217 and the summer time data stored in the eighth storage area 218, and rewrites the current time data stored in the first storage area 211 by the local time (step SK2).

In the reception (3) process shown in FIG. 24A, the CPU 208 receives the time data TD (step SL1). After that, the CPU 208 calculates the time difference between the received time data TD and the current time data stored in the first storage area 211 and then stores it in the third storage area 213 (step SL2).

Figure 24B:
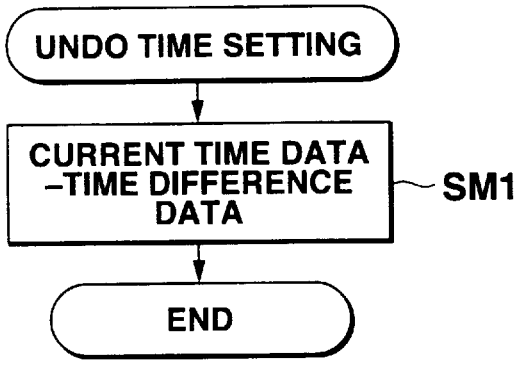

When it is instructed to undo the time setting by the user by performing a given operation on the switches 207, the CPU 208 operates in accordance with a flowchart shown in FIG. 24B to subtract the time difference stored in the third storage area 213 from the current time data stored in the first storage area 211 and thus corrects the current time data stored in the first storage area 211 (step SM1). Thus, even if the current time data has been overwritten by the received time data at step SJ11 in FIG. 21, a time setting UNDO operation will allow the current time data to be restored to the time data prior to rewriting.

Figure 25A:
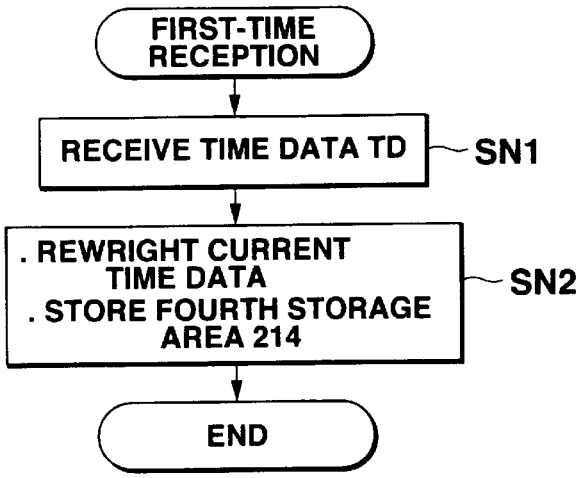
FIG. 25A is a flowchart for the first-time receive operation.
Figure 25B:
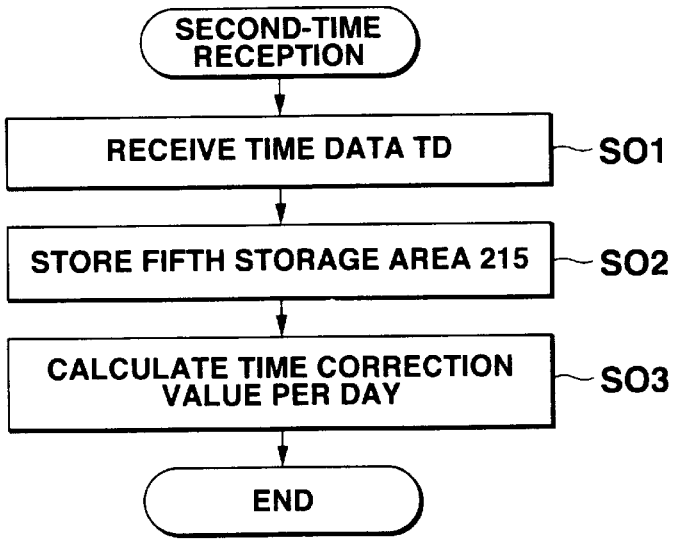
FIG. 25B is a flowchart for the second-time receive operation.
Figure 25C:
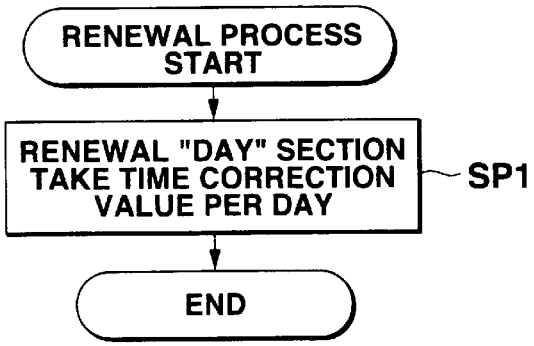
FIG. 25C is a flowchart for a correction process of "day" section.

In addition, the CPU 208 operates in accordance with flowcharts shown in FIGS. 25A to 25C to correct the time length of "day". The CPU 208 receives time data TD in the first-time reception (step SN1 in FIG. 25A). Then the CPU 208 corrects the current time data stored in the first storage area 211 by the received time data and stores the received time data TD in the fourth storage area 214 as first-received time data TD1 (step SN2). After that, the CPU 208 operates in accordance with a flowchart shown in FIG. 25B to receive time data TD again (step SO1) and then stores the received time data TD in the fifth storage area 215 as second-received time data TD2 (step S02). Subsequently to step S02, the CPU 208 calculates a time correction value per day based on the current time data rewritten at step SN2 and stored in the first storage area 211, the first-received time data TD1 stored in the fourth storage area 214, and the second-received time data TD2 stored in the fifth storage area 215 and then stores the time correction value per day in the sixth storage area 216 (step S03).

That is, in step S03, the CPU 208 first calculates the difference (hereinafter termed the first difference) between the rewritten current time data stored in the first storage area 211 and the first-received time data stored in the fourth storage area 214 and then calculates the difference (hereinafter termed the second difference) between the first-received time data stored in the fourth storage area 214 and the second-received time data stored in the fifth storage area 215. After that, the CPU 208 divides the first difference by the second difference. The result of division represents an error per the second difference, and thus it is possible to calculate the time correction value per day based on the result of division. If the second difference is 12 hours, the time correction value per day can be obtained by doubling the result of division. The accuracy of correction is improved if the second difference becomes longer. Therefore, the second reception time is set with considering the accuracy and an allowable waiting time for obtaining the correction value.

For a renewal process of "day", the CPU 208 corrects the "day" section in the current time data stored in the first storage area 211 by taking the time correction per day into consideration (step SP1 in FIG. 25C). This improves the accuracy of "day" in the time data generated by the wristwatch 201.

If the CPU 208 has corrected the current time data in step SJ11 in FIG. 21, it also operates in accordance with a flowchart shown in FIG. 26 to receive time data TD (step SQ1). After that, the CPU 208 adjusts the time zone data stored in the seventh storage area 217 based on the time difference (offset from GMT) included in the received time data TD (step SQ2). Further, the CPU 208 adjusts the summer time data stored in the eighth storage area 218 based on the summer time data included in the received time data TD (step SQ3).

Figure 27:
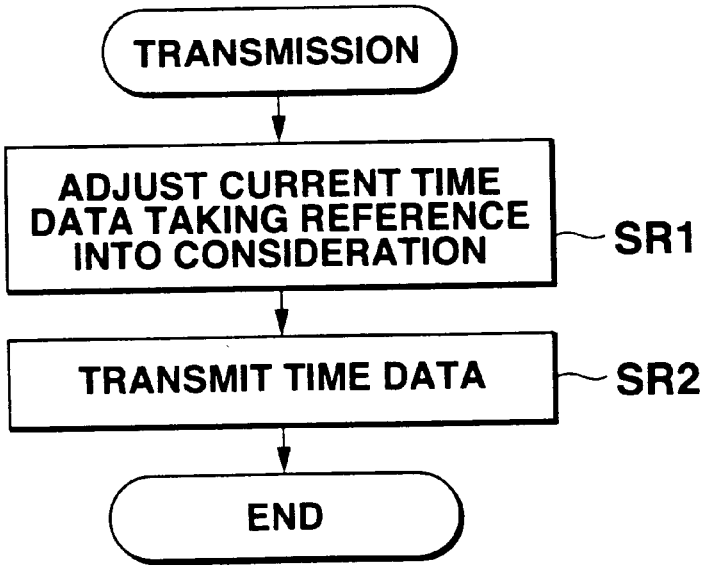
FIG. 27 is a flowchart for transmission procedure.

Additionally, the CPU 208 operates in accordance with a flowchart shown in FIG. 27 to perform a transmission process. That is, prior to transmission the CPU 208 adjusts the current time data by taking the time-measuring reference (atomic clock, GPS, radio controlled clock, TCXO, or built-in clock) into consideration (step SR1) and then transmits the adjusted time data (step SR2). Thus, the adjusted time data is sent through the CPU 208, the UART 234, the modem 236, and the Ir transmitter/receiver module 237 to outside. Another wristwatch can receive the time data thus transmitted and correct own time data stored in its first storage area by the received time data, whereby accuracy of the other wristwatch is also improved.

According to the second embodiment, the accuracy of the time data of the wristwatch can be greatly improved.

Third Embodiment

Figure 28:
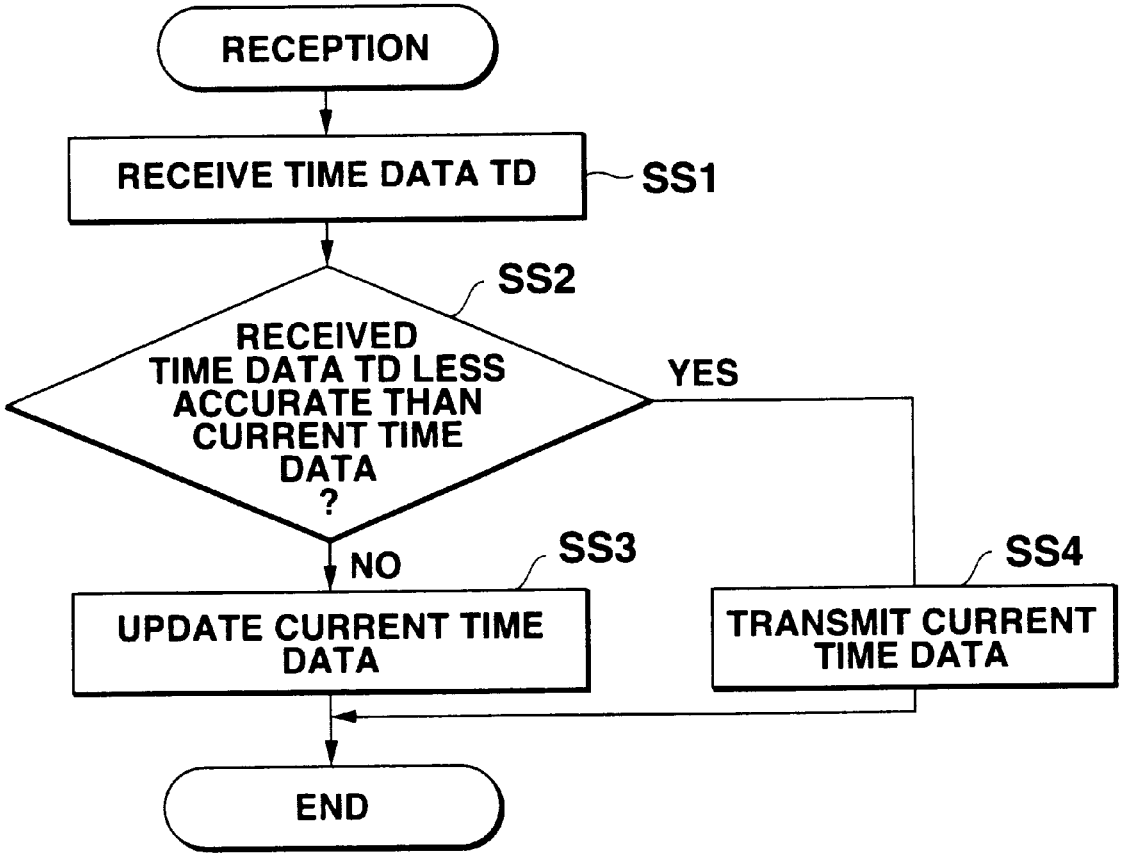
FIG. 28 is a flowchart for the reception procedure according to a third embodiment of the present invention.

The third embodiment has the same configuration as that of the second embodiment. FIG. 28 is a flowchart illustrating the CPU procedure according to the third embodiment. The CPU 208 receives time data TD transmitted from another wristwatch 201 (step SS1). A decision is next made as to whether the received time data TD is less accurate than the current time data (step SS2). As stated previously in connection with step SJ3 in FIG. 21, this decision is made by reading from the table 291 the rank of the time-measuring reference for the received time data TD and the rank of the time-measuring reference for the current time data and then making a comparison between them.

If the decision in step SS2 is that the received time data TD is more accurate than the current time data, then the current time data stored in the first storage area 211 is rewritten by the received time data (step SS3); otherwise, transmission mode is established without performing rewriting. In the transmission mode, the current time data stored in the first storage area 211 is sent to another wristwatch 211, whereupon its CPU operates in accordance with the flowchart shown in FIG. 21 to provide more accurate time.

According to the present invention, since the wristwatch 1 or 201 is equipped with the GPS module 11 or 231, time data can be received and the type of time-measuring reference can be changed even outdoors by setting the time-measuring reference of the wristwatch to GPS even where there is no infrared communications facility-installed electronic equipment nearby.

In this case, time data may be selectively received through infrared communications or GPS, depending on whether a person who wears the wristwatch is indoors or outdoors.

The present invention can eliminate such a disadvantage as the current time data information is undesirably corrected by less accurate time information and hence the clock accuracy is reduced.

In addition, time information can be prevented from being corrected against user's will.

Moreover, the embodiments allow the time display can be restored to that prior to correction and the time can be corrected including time difference information.

Furthermore, electronic equipment can make its timing operation more accurate.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents. Although the embodiments have been described in terms of a wristwatch, the present invention can be applied to pieces of clock function-installed electronic equipment such as video recorders, electronic notebooks, etc.

What is claimed is:

1. An electronic device with a clock function comprising:

clocking means for providing time-of-day information;

first storage means for storing the time-of-day information provided by said clocking means and a type of a time-measuring reference to which said clocking means is referenced;

display means for displaying the time-of-day information stored in said first storage means;

second storage means for storing types of time-measuring references and their respective accuracy;

receiving means for receiving data transmitted from outside;

detecting means for detecting time-of-day information and a corresponding type of time-measuring reference from the data received by said receiving means;

determining means for determining the accuracy of the time-measuring reference detected by said detecting means and the accuracy of the time-measuring reference stored in said first storage means based on contents of said second storage means; and control means for controlling contents of said first storage means based on a results of the determination by said determining means.

2. The electronic device according to claim 1, wherein said control means comprises correcting means for, when said determining means determines that the accuracy of the type of time-measuring reference detected by said detecting means is higher than the accuracy of the type of time-measuring reference stored in said first storage means, correcting the time-of-day information stored in said first storage means by the time-of-day information detected by said detecting means.

3. The electronic device according to claim 2, further comprising:

third storage means for storing a difference between the time-of-day information before correcting and the time-of-day information after correcting;

instruction means for giving an instruction to switch display of the time-of-day information; and switch means responsive to the instruction given by said instruction means for switching the display of the time-of-day information to display the difference stored in said third storage means.

4. The electronic device according to claim 1, further comprising:

prompt display means for, when said determining means determines that the accuracy of the type of time-measuring reference detected by said detecting means is lower than the accuracy of the type of time-measuring reference stored in said first storage means, prompting a user to instruct whether or not to correct the time-of-day information stored in said first storage means by the time-of-day information detected by said detecting means; and instruction detecting means for detecting a correct instruction; and wherein said control means comprises correcting means for, when the correct instruction is detected by said instruction detecting means, correcting the time-of-day information stored in said first storage means by the time-of-day information detected by said detecting means.

5. The electronic device according to claim 4, further comprising:

third storage means for storing a difference between the time-of-day information before correcting and the time-of-day information after correcting;

instruction means for giving an instruction to switch the display of the time-of-day information; and switch means responsive to the instruction given by said instruction means to display the difference stored in said third storage means.

6. The electronic device according to claim 1, further comprising fourth storage means for storing the time-of-day information that has corrected the time-of-day information stored in said first storage means and the type of time-measuring reference to which the time-of-day information is referenced.

7. The electronic device according to claim 1, wherein said receiving means receives data transmitted in a form of an infrared signal.

8. The electronic device according to claim 1, further comprising:

fifth storage means for storing time-difference information; and correcting means for correcting the time-of-day information stored in said first storage means in accordance with the time-difference information stored in said fifth storage means.

9. The electronic device according to claim 1, further comprising:

receive control means for causing said receiving means to receive data twice; and adjust means for adjusting a day section included in said time-of-day information provided by said clocking means based on two items of the data received by said receive control means.

10. The electronic device according to claim 1, further comprising:

sixth storage means for storing the types of time-measuring references and corresponding display contents; and display control means for determining the type of time-measuring reference stored to correspond with time-of-day information and displaying the display contents corresponding to that type of time-measuring reference of said sixth storage means on said display means.

11. The electronic device according to claim 1, wherein said device has a shape adapted to be worn on an arm.

12. A time correction method comprising:

clocking step of providing time-of-day information;

first storage step of storing the time-of-day information provided by the clocking step and the type of a time-measuring reference to which said clocking step is referenced;

display step of displaying the time-of-day information stored by said first storage step;

receiving step of receiving data transmitted from outside;

detecting step of detecting time-of-day information and the corresponding type of time-measuring reference from the received data by said receiving step;

determining step of determining the accuracy of the time-measuring reference detected by said detecting step and the accuracy of the time-measuring reference stored by said first storage step based on types of time-measuring references and their respective accuracy which have been set in advance; and first correction step of correcting contents stored by said first storage step based on the accuracy determined by said determining step.

13. The time correction method according to claim 12, wherein said first correction step comprises step of, when said determining step determines that the accuracy of the type of time-measuring reference detected by said detecting step is higher than the accuracy of the type of time-measuring reference stored by said first storage step, correcting the time-of-day information stored by said first storage step by the time-of-day information detected by said detecting step.

14. The time correction method according to claim 12, further comprising:

third storage step of storing a difference between the time-of-day information before correcting and the time-of-day information after correcting;

instruction step of giving an instruction to switch the display of the time-of-day information; and switch step of, in response to the instruction given by said instruction step, switching the display of the time-of-day information to display the difference stored by said third storage step.

15. The time correction method according to claim 12, further comprising:

prompt step of, when said determining step determines that the accuracy of the type of time-measuring reference detected is lower than the accuracy of the type of time-measuring reference stored by said first storage step, prompting a user to instruct whether or not to correct the time-of-day information stored by said first storage step by the time-of-day information detected; and instruction detecting step of detecting a correct instruction; and wherein said correction step comprises step of, when the correct instruction is detected by the instruction detecting step, correcting the time-of-day information stored by said first storage step by the time-of-day information detected.

16. The time correction method according to claim 12, further comprising:

fourth storage step of storing time-difference information; and correction step of correcting the time-of-day information stored by said first storage step in accordance with the time-difference information stored by said fourth storage step.

17. The time correction method according to claim 12, further comprising:

receive control step of causing said receiving step to receive data twice; and adjust step of adjusting a day section included in said time-of-day information based on two items of the data received by said receive control step.

18. The time correction method according to claim 12, further comprising:

sixth storage step of storing the types of time-measuring references and corresponding display contents; and display control step of determining the type of time-measuring reference stored to correspond with time-of-day information and displaying the display contents corresponding to that type of time-measuring reference of said sixth storage step.

19. A storage medium storing program codes readable by a computer that control an electronic device equipped with a function of providing time-of-day information, a function of storing the time-of-day information, and a function of displaying the time-of-day information, said program codes for implementing:

a function of storing types of time-measuring references and their respective accuracy;

a function of receiving data transmitted from outside;

a function of detecting time-of-day information and the corresponding type of time-measuring reference from the received data;

a function of determining the accuracy of the time-measuring reference detected and the accuracy of the time-measuring reference stored based on types of time-measuring references and their respective accuracy which have been stored in advance; and a function of correcting the stored time-of-day information based on the accuracy determined.

* * * * *